US006729617B1

(12) United States Patent
Chaume et al.

(10) Patent No.: US 6,729,617 B1
(45) Date of Patent: May 4, 2004

(54) DEVICE FOR CONVEYING FLAT OBJECTS WITH A SYNCHRONIZATION SYSTEM

(75) Inventors: Francois Chaume, Saint Marcel les Valence (FR); Laurent Buffat, Romans (FR); Claude Diebold, Valence (FR)

(73) Assignee: Solystic, Gentilly Cedex (FR)

( * ) Notice: Subject to any disclaimer, the term of this patent is extended or adjusted under 35 U.S.C. 154(b) by 0 days.

(21) Appl. No.: 10/031,498

(22) PCT Filed: Aug. 1, 2000

(86) PCT No.: PCT/EP00/07448

§ 371 (c)(1),
(2), (4) Date: May 7, 2002

(87) PCT Pub. No.: WO01/10761

PCT Pub. Date: Feb. 15, 2001

(30) Foreign Application Priority Data

Aug. 9, 1999 (FR) ..... 99 10308

(51) Int. Cl.[7] ..... B65H 5/02; B65H 5/04

(52) U.S. Cl. ..... 271/272; 271/274; 198/604; 198/621.1

(58) Field of Search ..... 271/10.01, 10.03, 271/259, 270, 272, 274; 198/575, 577, 604, 626.1

(56) References Cited

U.S. PATENT DOCUMENTS 4,077,620 A * 3/1978 Frank et al. ..... 271/259
4,451,027 A * 5/1984 Alper ..... 271/259
6,170,816 B1 * 1/2001 Gillmann et al. ..... 271/10.03
6,270,070 B1 * 8/2001 Salomon et al. ..... 271/259
6,354,583 B1 * 3/2002 Skadow et al. ..... 271/10.03
6,378,859 B1 * 4/2002 Lubben et al. ..... 271/10.03
6,499,733 B1 * 12/2002 Oberhoffner et al. .... 271/10.03

* cited by examiner

*Primary Examiner*—Gene O Crawford
(74) *Attorney, Agent, or Firm*—Pitney Hardin Kipp & Szuch LLP

(57) ABSTRACT

A device for conveying flat objects in series and edge-on, in which the flat objects (12) are moved in a conveying direction (D), while at the same time being separated each from the next by a spacing which is normally constant, has a synchronization system (2) capable of compensating for any variations in spacing between two consecutive objects. The system includes two parallel rows (3, 4) of driven wheels (3A–4C) made of elastically deformable elastomer and between which each object is gripped and moved in the conveying direction. Each wheel has a rotation spindle (6), the position of which is fixed, and the wheels are rotated by a motorization system which is controlled to accelerate and/or retard the movement of each object between the two rows of wheels on the basis of a detection whether the front edge of the object has been early or late in passing a determined position upstream of the two rows of wheels compared with a time reference indicating the spacing between objects. The device may be used in a postal sorting machine operating in a synchronous mode.

15 Claims, 1 Drawing Sheet

DEVICE FOR CONVEYING FLAT OBJECTS WITH A SYNCHRONIZATION SYSTEM

Figure 1:
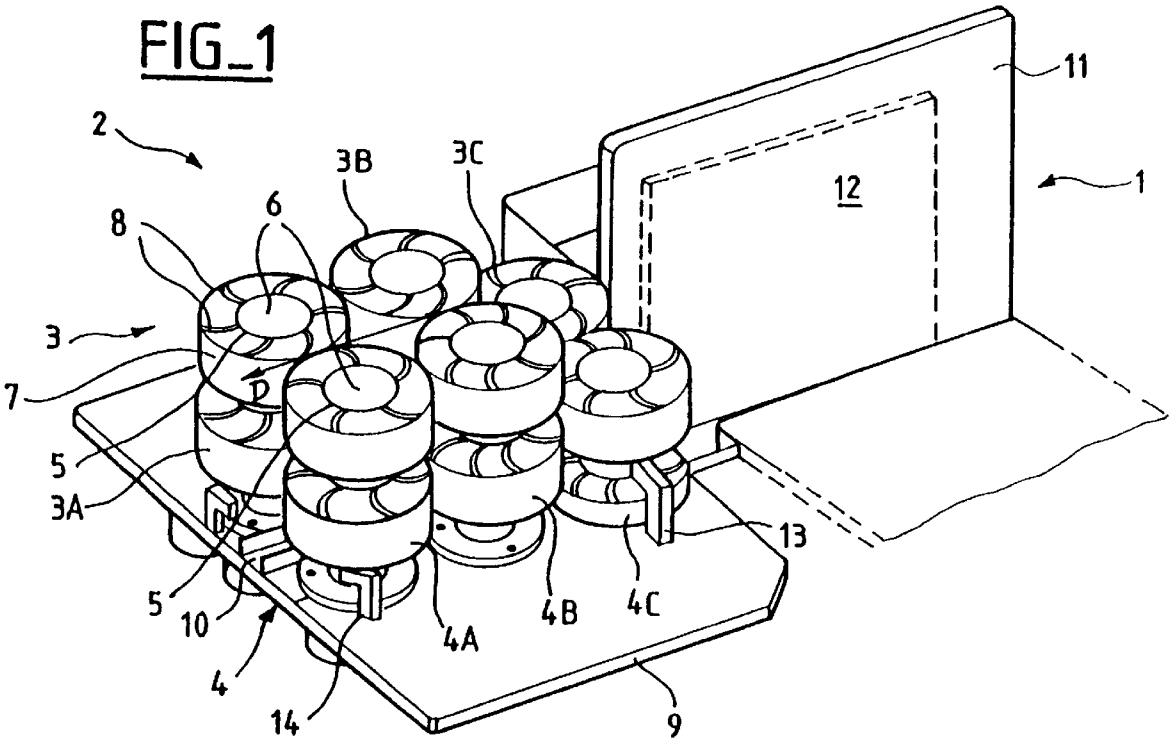

The invention relates to a device for conveying flat objects in which said flat objects are moved along in series and edge-on in a conveying direction, while at the same time being separated each from the next by a spacing which is normally constant. The invention applies more particularly to a device for conveying flat objects for a postal sorting machine operating in synchronous mode.

In this type of machine, it is necessary that the conveying of flat objects in an upstream part of the machine, for example corresponding to the exit of a destacker of flat objects, be synchronized with the conveying thereof in a downstream part of this machine which, for example, might correspond to the entry to a bucket conveyor. The flat objects are generally conveyed in series and edge-on at constant speed by conveyor belts between the destacker and the bucket conveyor, and the spacing separating two consecutive objects needs to be large enough that a flat object can be transferred into a bucket in the period of time that separates the arrival of two flat objects entering the bucket conveyor.

Users of this type of sorting machine want to be able to process an ever broadening range of flat objects, that is to say flat objects the height, width and thickness dimensions of which vary greatly. The variations in thickness of the flat objects are, in particular, the source of offsets between consecutive objects as they are conveyed between the upstream part and the downstream part of the machine. If the sorting machine is operated in synchronous mode, these offsets are not tolerable and the objects which are offset from the reference time frame have to be rejected from the belt conveyor before they reach the bucket conveyor. The rejection of flat objects affects the sorting rate of the machine and one object of the invention is to overcome this drawback*.

<U.S. Pat. No. 4,077,620 discloses a synchronization system capable of compensation variations in spacing between objects. But this system operates only in a destacker and not at any position on a belt conveyor.>

To this end, the subject of the invention is a device for conveying flat objects in series and edge-on, in which the said flat objects are moved in a conveying direction, while at the same time being separated each from the next by a spacing which is normally constant, which device further comprises a synchronization system capable of compensating for any variations in spacing between two consecutive objects charaterized in that this system comprises two parallel rows of driven wheels made of elastically deformable elastomer and between which each object is gripped and moved in said conveying direction, each wheel having a rotation spindle, the position of which is fixed, and the wheels being rotated by a motorization system which is controlled to accelerate and/or retard the movement of each object between the two rows of wheels on the basis of a detection as to whether the front edge of the object has been early or late in passing a determined position upstream of the two rows of wheels, compared with a time reference which indicates the spacing between objects.

This synchronization system may in particular be arranged in the continuation of the exit of a destacker of a postal sorting machine to accelerate movement of the flat objects toward the bucket conveyor while at the same time keeping the spacing separating two consecutive objects constant. In this case, if the destacker of flat objects comprises a destacking plate on which the first object of the stack of objects that are to be sent out in sequence rest before being ejected at the exit of the destacker, this plate is preferably arranged in a vertical plane parallel to the two rows of wheels and offset from said direction of conveying between the two rows of wheels by a distance which essentially corresponds to half the maximum thickness of an object. With this construction, the thickest and therefore the most rigid, flat objects are not diverted as they enter between the two rows of wheels, thus simplifying the control of their position in the conveying direction.

The setup whereby the synchronization system comprises elastomer wheels is a mechanically very simple construction and furthermore allows the conveying of relatively thick flat objects, for example flat objects about 32 mm thick, using wheels of a diameter of 150 mm. In one particular embodiment of the conveying device according to the invention, each wheel comprises a hub and an annular tread strip connected to the hub by elastically deformable circular arc-shaped fins, the two ends of each fin which are for connecting to the hub and to the annular tread strip of the wheel being located on a radius of the wheel. The particular circular arc-shaped profile of the fins with points of attachment located on the radius of the wheel, allows the elastomer to work over the entire length of the fins when the wheel is compressed, without creating any stress concentration zones, thus extending the life of the wheels and therefore increasing the availability of the synchronization system.

The conveying device according to the invention is described hereinafter in detail in relation to the figures.

FIG. 1 very diagrammatically the conveying device with a synchronization system according to the invention, arranged in the continuation of a destacker of a postal sorting machine.

Figure 3:
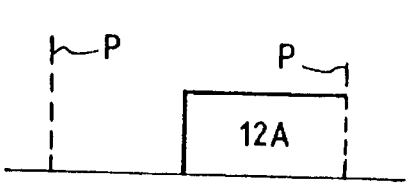
Figure 2:
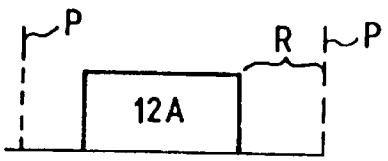

FIGS. 2 and 3 respectively illustrate a flat object shifted from its conveying spacing and a flat object which has been returned to its rightful position with respect to the conveying spacing.

The device for conveying flat objects is therefore intended to be inserted more particularly between a destacker 1 and a bucket conveyor (not depicted) of a synchronous postal sorting machine. Of course, the movement of the objects in the destacker and in the conveyor of objects and the movement of the buckets are synchronized to make sure that each object leaving the object conveyor is transferred into a bucket. This synchronization is provided, for example, by using conventional means to command the movement of the buckets at constant speed and by slaving the exit of an object from the destacker 1 according to the passage of a bucket past a determined position.

In the object conveyor, which is of the belt or similar type, the objects are moved in series and on edge, separated one from the next by spacing which is normally constant so as to ensure that a flat object is transferred into a bucket within the period of time that separates the ejection of two consecutive objects leaving the object conveyor. This separation spacing corresponds to the distance between the front faces of two consecutive objects.

The object conveyor according to the invention comprises a synchronization system 2 capable of compensating for variations in spacing between two consecutive objects. In the figure, the synchronization system 2 is arranged in the immediate continuation of the exit of the destacker 1 to accelerate the speed at which each object travels as it leaves the destacker. It comprises two parallel rows 3,4 of twin driving wheels 3A,3B,3C and 4A,4B,4C made of elastically deformable elastomer and between which each object is gripped so that it can be moved along in the conveying direction indicated by the arrow D.

More specifically, as visible in the figure, each wheel of a row 3 faces, at right angles to the conveying direction D, a wheel of the other row 4.

Each elastically deformable elastomer wheel has a hub 5 mounted on a rotation spindle 6 in a fixed position, an annular tread strip 7 coaxial with the hub 5 and connected thereto by elastically deformable circular arc-shaped fins 8. The two ends of each fin 8 which ends are for connecting to the hub and to the annular tread strip of the wheel are located on a radius of the wheel.

As visible in the figure, each rotation spindle 6 of a wheel of the synchronization system carries two twin wheels arranged in superposition over a certain height that is suited to the greatest width of a flat object in the vertical direction. As visible in the figure, the wheels 3C and 4C placed upstream of the synchronization system 2 in the direction D extend over a shorter height than the wheels 3A,3B and 4A,4B placed downstream of the synchronization system in the direction D, thus making it possible to prevent each flat object being curved when gripped between the wheels 3C and 4C which will accelerate its movement.

The spindles of the wheels of the two rows of wheels 3 and 4 are fixed to a mounting plate 9 on each side of a sole plate 10 that guides the bottom of the flat objects on edge and which runs in the direction D and is parallel to the destacking plate 11 of the destacker 1 on which, before being ejected at the exit of the destacker 1, the first object such as 12 of the stack of objects that are to be sent out in sequence, stored in the magazine of the destacker 1, rests.

The destacking plate 11 is more particularly arranged in a vertical plane parallel to the two rows of wheels but offset from said direction of conveying D between the two rows of wheels by a distance which essentially corresponds to half the maximum thickness of an object, which means that the thickest objects are not diverted when gripped between the wheels 3C and 4C. In particular, the destacking plate 11 is offset toward the wheels 3A,3B,3C and the hardness of the wheel 3C is designed to be slightly greater than that of the wheel 4C so as to force each flat object, particularly the thinnest ones, to position themselves in alignment between the two rows of wheels.

The wheels 3A to 4C are rotated by a common drive means (not depicted in the figure). This drive means is controlled in such a way as to compensate for discrepancies in the positioning of each flat object with respect to a reference time frame supplied, for example, as indicated hereinabove, by the bucket conveyor. In particular, the synchronization system comprises a first sensor 13, of the light-emitting diode type, or the like, provided upstream of the synchronization system and more specifically just before the rotation spindles of the wheels 3C and 4C, so as to detect the passage of the front face of each flat object ejected at the exit of the stacker and engaging between the wheels 3C and 4C. If the detection of the passage of the object past the sensor 13 is late or early in comparison with the reference time frame signal, the drive means is commanded to accelerate or, correspondingly, retard, the movement of this object so as to reposition its front face in the reference time frame. The elastically deformable elastomer wheels in this instance allow positive or negative torque to be transmitted to the flat objects without damaging them. If the difference between the instant that the flat object passes past the sensor 13 and the reference time frame signal is too great, this flat object is positioned by the synchronization device in the next reference time frame at the same as the stacker 1 is temporarily halted to allow an empty time frame to pass.

The speed law that the synchronization device forces a flat object that is late with respect to the reference time frame to follow, is a speed law which corresponds to an acceleration followed by a retardation down to a constant conveying speed. If the flat object is early by comparison with the reference time frame, the speed law is a deceleration down to the conveying speed.

In FIG. 2, an object 12A has its front face late with respect to the conveying spacing P by a distance R. In FIG. 3, this object 12A has been returned to the correct position with respect to the conveying spacing P. In all instances, the flat object 12A leaves the synchronization system at constant speed. To fulfil this function of adjusting the speed and position of the flat objects, the two rows of wheels 3 and 4 extend along a length in the direction D that is slightly greater than the longest length of a flat object. Another sensor 14 is also provided downstream of the synchronization system and more particularly just behind the rotation spindles of the wheels 3A and 4A, to detect the passage of the rear face of the flat object which has been moved between the two rows of wheels. In response to this detection, the drive system is commanded to pick up the next object leaving the destacker at the ejection speed of this object (which is normally lower than the conveying speed).

By using a conveyor such as this, equipped with a synchronization system, it is possible to increase the sorting rate of a postal sorting machine.

The synchronization system may perfectly well be positioned at any position on a belt conveyor for adjusting the speed and position of the flat objects downstream of the synchronization system. However, in such a configuration, it is not possible to compensate for excessively large discrepancies in the position of the flat objects by skipping a reference time frame, and it is only a rejection function that can achieve such compensation, to the detriment of the sorting rate of a postal sorting machine.

What is claimed is:

1. A device for conveying flat objects in series and edge-on, in which said flat objects are moved in a conveying direction while at the same time being separated each from the next by a spacing which is normally constant, which device further comprises a synchronization system capable of compensating for any variations in spacing between two consecutive objects, wherein this system further comprises two parallel rows of driven wheels made of elastically deformable elastomer and between which each object is gripped and moved in said conveying direction, each wheel having a rotation spindle, the position of which is fixed, each fixed-position rotation spindle comprising two twin wheels, the wheels of the two rows of wheels located upstream in the direction of conveying extending over a shorter height than the wheels located downstream, and the wheels being rotated by a motorization system which is controlled to accelerate and/or retard the movement of each object between the two rows of wheels on the basis of a detection as to whether the front edge of the object has been early or late in passing a determined position upstream of the two rows of wheels, compared with a time reference which indicates the spacing between objects.

2. The device as claimed in claim 1, comprising a first sensor disposed close to the upstream wheels of the two rows of wheels in the conveying direction and arranged to detect the passage of the front edge of each flat object, and a second sensor disposed close to the downstream wheels of the two rows of wheels in the conveying direction and arranged to detect the passage of the rear edge of each flat object, and in which, in response to detection by the first sensor, the motorization system is controlled to accelerate and/or retard the movement of the flat object between the two rows of wheels to a certain conveying speed and in which, in response to detection by the second sensor, the motorization system is controlled to pick up a subsequent object between the two rows of wheels at a certain speed which is lower than said conveying speed, and in which if first said sensor detects the passage of the front edge of a flat object which is delayed with respect to said time reference, the motorization system is controlled to accelerate and then retard the movement of the flat object between the two rows of wheels until said certain conveying speed is reached.

3. The device as claimed in claim 1, in which the two rows of wheels extend over a length in said conveying direction which is slightly longer than the longest length of a flat object.

4. The device as claimed in claim 1, in which said synchronization system has a first wheel in one of said two rows of wheels and a second wheel in the other of said two rows of wheels, said first wheel being in contact with said second wheel, and wherein said first wheel has a hardness which is slightly greater than the hardness of said second wheel.

5. A device for conveying flat objects in series and edge-on, in which said flat objects are moved in a conveying direction while at the same time being separated each from the next by a spacing which is normally constant, which device further comprises a synchronization system capable of compensating for any variations in spacing between two consecutive objects, wherein this system further comprises two parallel rows of driven wheels made of elastically deformable elastomer and between which each object is gripped and moved in said conveying direction, each wheel having a rotation spindle, the position of which is fixed, the wheels being rotated by a motorization system which is controlled to accelerate and/or retard the movement of each object between the two rows of wheels on the basis of a detection as to whether the front edge of the object has been early or late in passing a determined position upstream of the two rows of wheels, compared with a time reference which indicates the spacing between objects, and in which each wheel comprises a hub and an annular tread strip connected to the hub by elastically deformable circular arc-shaped fins, the two ends of each fin which are for connecting to the hub and to the annular tread strip of the wheel being disposed along a common radius of the wheel.

6. The device as claimed in claim 5, comprising two twin wheels on each fixed-position rotation spindle, and in which the wheels of the two rows of wheels located upstream in the direction of conveying extend over a shorter height than the wheels located downstream.

7. The device as claimed in claim 5, comprising a first sensor disposed close to the upstream wheels of the two rows of wheels in the conveying direction and arranged to detect the passage of the front edge of each flat object, and a second sensor disposed close to the downstream wheels of the two rows of wheels in the conveying direction and arranged to detect the passage of the rear edge of each flat object, and in which, in response to detection by the first sensor, the motorization system is controlled to accelerate and/or retard the movement of the flat object between the two rows of wheels to a certain conveying speed and in which, in response to detection by the second sensor, the motorization system is controlled to pick up a subsequent object between the two rows of wheels at a certain speed which is lower than said conveying speed, and in which if first said sensor detects the passage of the front edge of a flat object which is delayed with respect to said time reference, the motorization system is controlled to accelerate and then retard the movement of the flat object between the two rows of wheels until said certain conveying speed is reached.

8. The device as claimed in claim 5, in which the two rows of wheels extend over a length in said conveying direction which is slightly longer than the longest length of a flat object.

9. The device as claimed in claim 5, in which said synchronization system has a first wheel in one of said two rows of wheels and a second wheel in the other of said two rows of wheels, said first wheel being in contact with said second wheel, and wherein said first wheel has a hardness which is slightly greater than the hardness of said second wheel.

10. A postal sorting machine comprising a destacker of flat objects and a device for conveying flat objects in series and edge-on, in which said flat objects are moved in a conveying direction while at the same time being separated each from the next by a spacing which is normally constant, which device further comprises a synchronization system capable of compensating for any variations in spacing between two consecutive objects, this system comprising two parallel rows of driven wheels made of elastically deformable elastomer and between which each object is gripped and moved in said conveying direction, each wheel having a rotation spindle, the position of which is fixed, the wheels being rotated by a motorization system which is controlled to accelerate and/or retard the movement of each object between the two rows of wheels on the basis of a detection as to whether the front edge of the object has been early or late in passing a determined position upstream of the two rows of wheels, compared with a time reference which indicates the spacing between objects, said destacker having an exit and said conveying device being arranged in the continuation of the destacker exit, the destacker comprising a destacking plate on which the first object of a stack of objects that are to be sent out in sequence rests before being ejected at the exit of the destacker, this plate being arranged in a vertical plane parallel to said direction of conveying between the two rows of wheels and offset from said direction by a distance which corresponds to half the maximum thickness of an object.

11. A postal sorting machine as claimed in claim 10, in which the conveying device comprises two twin wheels on each fixed-position rotation spindle, the wheels of the two rows of wheels located upstream in the direction of conveying extending over a shorter height than the wheels located downstream.

12. A postal sorting machine as claimed in claim 10, in which the conveying device comprises a first sensor disposed close to the upstream wheels of the two rows of wheels in the conveying direction and arranged to detect the passage of the front edge of each flat object, and a second sensor disposed close to the downstream wheels of the two rows of wheels in the conveying direction and arranged to detect the passage of the rear edge of each flat object, and in which, in response to detection by the first sensor, the motorization system is controlled to accelerate and/or retard the movement of the flat object between the two rows of wheels to a certain conveying speed and in which, in response to detection by the second sensor, the motorization system is controlled to pick up a subsequent object between the two rows of wheels at a certain speed which is lower than said conveying speed, and in which if first said sensor detects the passage of the front edge of a flat object which is delayed with respect to said time reference, the motorization system is controlled to accelerate and then retard the movement of the flat object between the two rows of wheels until said certain conveying speed is reached.

13. A postal sorting machine as claimed in claim 10, in which the two rows of wheels of the conveying device extend over a length in said conveying direction which is slightly longer than the longest length of a flat object.

14. A postal sorting machine as claimed in claim 10, in which each wheel of the conveying device comprises a hub and an annular tread strip connected to the hub by elastically deformable circular arc-shaped fins, the two ends of each fin which are for connecting to the hub and to the annular tread strip of the wheel being disposed along a radius of the wheel.

15. A postal sorting machine as claimed in claim 10, in which said synchronization system has a first wheel in one of said two rows of wheels and a second wheel in the other of said two rows of wheels, said first wheel being in contact with said second wheel, and wherein said first wheel has a hardness which is slightly greater than the hardness of said second wheel.

* * * * *